US006699144B1

(12) United States Patent
Kvitek

(10) Patent No.: US 6,699,144 B1
(45) Date of Patent: Mar. 2, 2004

(54) POWDER DISPENSING GOLF BALL MARKER WITH BUILT-IN DIVOT REPAIR TOOL

(75) Inventor: Aaron A. Kvitek, Santa Monica, CA (US)

(73) Assignee: Golfing Innovations, LLC, Santa Monica, CA (US)

( * ) Notice: Subject to any disclaimer, the term of this patent is extended or adjusted under 35 U.S.C. 154(b) by 0 days.

(21) Appl. No.: 10/290,756

(22) Filed: Nov. 8, 2002

Related U.S. Application Data

(60) Provisional application No. 60/371,487, filed on Apr. 10, 2002.

(51) Int. Cl.[7] ..... A63B 57/00
(52) U.S. Cl. ..... 473/408; 473/406
(58) Field of Search ..... 473/406, 408, 473/285, 286

(56) References Cited

U.S. PATENT DOCUMENTS 1,756,141 A * 4/1930 Spellmeyer ..... 473/285
2,892,633 A * 6/1959 Eckert ..... 473/285
4,553,752 A * 11/1985 Bagg ..... 473/406
4,951,947 A * 8/1990 Kopfle ..... 473/408
5,419,551 A * 5/1995 Hoyt et al. ..... 473/406
6,447,407 B1 * 9/2002 Caldwell ..... 473/408

FOREIGN PATENT DOCUMENTS

CA 522100 * 2/1956 ..... 273/32 A

* cited by examiner

*Primary Examiner*—Steven Wong
(74) *Attorney, Agent, or Firm*—Blakely Sokoloff Taylor & Zafman LLP

(57) ABSTRACT

In one embodiment, a powder chamber features an upper end attached to a divot axle housing. Both the chamber and housing are formed by two separate half units that are brought together into a single unit in an assembly process. A divot repair tool axle is captured between these two halves in this assembly process by entering corresponding female slots of the divot axle housing. The shaft of the divot repair tool rests in this slot when the tool is fully opened and closed. The axle of the divot repair tool allows the tool to swing upon an axis into open and closed positions. A decorative sleeve is slid over the assembled powder chamber and locked securely into place connected to a base of the divot axle housing as well as to the powder chamber. A powder release mechanism is attached to an open end of the powder chamber.

18 Claims, 6 Drawing Sheets

POWDER DISPENSING GOLF BALL MARKER WITH BUILT-IN DIVOT REPAIR TOOL

CROSS REFERENCE TO RELATED APPLICATIONS

This application claims the benefit of priority on U.S. Provisional Application No. 60/371,487, filed Apr. 10, 2002.

FIELD

Embodiments of the invention relate to golf ball marking and divot repair tool used by golfers on a putting green.

GENERAL BACKGROUND

Golfers commonly use a ball marking device while on the putting green to mark the spot where their ball came to rest. These devices allow them to pick up and remove their ball from the putting surface. The principal reason for removing their ball is to prevent it from interfering with the putt of another player whose ball came to rest further away from the cup. The player furthest away from the cup putts first.

Currently, a wide range of plastic and metal coin-sized ball marking devices are used as ball markers. In fact, many golfers often use an actual coin as a ball marker. Current ball marking devices are commonly carried either loosely in the pocket, snapped to the top of a divot repair tool which is carried in the pocket, snapped to the top of a putter club grip handle, or take the form of a removable snap attached to the back of a golf glove.

However, these conventional ball marking devices have a number of common disadvantages. First of all, these ball marking devices have a three-dimensional physical presence when placed on the putting surface, even if the golfer takes extra care to firmly push the marker into the turf. Therefore, a ball putt from any direction can still roll into/over the ball marking device and have its path altered in some way. This type of interference defeats the principal reason for marking and removing the ball in the first place. Secondly, conventional ball marking devices are frequently and easily lost or misplaced. After a golfer walks onto the putting green and realizes that his/her marker was lost or misplaced, play must often be delayed while the golfer endures the inconvenience of walking back to his/her cart and digging through crowded golf bag pockets to find a replacement marker or coin. Finally, many golfers do not like to carry loose items in their pockets. The movement, weight, and/or presence of pocket items interferes with their play.

When a ball is hit high into the air and lands on the putting green, it commonly leaves an indentation called a divot. Golfers are encouraged to repair this divot by using a divot repair tool. Normally made of either plastic or metal of varying composition, thickness and strength, divot repair tools have a two-pronged fork and a short handle just wide enough and long enough to fit between thumb and forefinger. The fork prongs are inserted into the turf around the impacted area. The turf is then pried as best as possible back into its original flat surface shape, thereby eliminating the indentation. Divot repair tools are usually carried in the pocket or retrieved from the golf cart or a golf bag pocket when needed.

Current divot repair tools present two main disadvantages. First of all, since they are relatively small in size, they are easily and often lost or misplaced, thereby presenting delays in play or inconveniences to the golfer who has discovered that the tool had been lost or misplaced and must search for another in his/her bag. Secondly, many golfers do not like to carry items in their pockets. Metal divot repair tools can be heavy and therefore distracting and uncomfortable in the pocket. In fact, if unfortunately positioned, these fork prongs can cause injury to the user when forcefully applied against the leg of the user or poke holes in the user's pockets.

Some divot repair tools also have a coin-sized ball marker attached via snap or magnet to the flat "handle" area where the thumb and forefinger are placed. This all-in-one tool allows golfers to only carry one tool for their putting green ball mark needs. However, since the design and functionality of the ball marker and divot repair components remain unchanged from the separate devices already discussed, this combination device shares the same list of disadvantages.

Many ball markers and divot repair tools are designed in such a way as to appeal to a golfer's sense of fashion or self expression. These devices offer unique, often artistic designs or shapes or are made of special materials such as gold or silver plated metal. The golfer must often pay a premium for these fashionably designed ball markers and divot tools. Yet the devices remain for the most part in their pocket or in a pocket in their golf bag, thus defeating the purpose of paying a premium to make a fashion statement.

It is also extremely common for corporations and golf courses to place their name and/or logo on golf ball markers or divot repair tools. However, the lack of any appreciable amount of surface area make for placement of advertisement logos ineffective. Also, given the fact that both of these devices are most often carried in the pocket, the corporate name and logo is not visible to other players, except for perhaps a brief glimpse when the device is taken out and used. This lack of visibility reduces the promotional value of these devices.

It should be noted that there already exists a ball marking device that dispenses a circle of powder to mark the spot where the ball came to rest. It is a small cylindrical device about the size of a CHAPSTICK® tube. A ball bearing sticks partially out of one slightly tapered first end. The ball bearing is kept in place by a removable spring which spans the entire length inside the cylinder. Powder is inserted into the hollow cylinder via a screw cap located at a second end opposite the first end. The spring loaded ball bearing forms a seal on the tapered end preventing the powder from escaping. When the spring loaded ball end of the device is pressed against the putting surface, the ball is pushed into the cylinder and the powder then flows out through the opening. When lifted from the putting surface, the spring pushes the ball back into the tapered end thus reforming the seal. However, the conventional powder dispensing device suffers from a number of disadvantages:

a. It is small and designed to be carried in the golfer's pocket, in a golf bag pocket, or in a golf cart compartment. Therefore, it is easily lost or misplaced, thus causing delays in play and inconveniences associated with digging through golf bag pockets looking for it.

b. Many golfers do not like to keep items in their pocket. For these golfers, the only option would be to place this device in a golf bag pocket or in a golf cart compartment. It is therefore easy for these golfers to forget to grab this device before they walk onto the putting green after grabbing their putter. In this instance, it would be inconvenient and cause delays for them to return to the cart or golf bag to retrieve the device if it was needed.

c. Even if the device is carried in a golfer's pocket, powder can easily be accidentally dispensed inside the pocket, thereby causing a mess.

d. Once the device is being firmly pressed against the turf, there is nothing to prevent powder from continuing to flow out of the device. The only way to stop the flow of powder is to lift the device off the turf. If the golfer is not careful, he/she can consistently dispense more powder than was needed. This would result in the need to refill the device more often than necessary, which would be especially inconvenient if the device ran out of powder in the middle of a round of golf and the golfer did not have replacement powder available.

e. The small ball bearing can get dirty or wet, resulting in powder getting clogged on the tapered end and preventing it from operating properly. If this happens, then the ball, spring and all the remaining powder must be removed from the screw cap end in order to remove the ball, clean it and get it working again. This is time consuming and could cause a delay in play if the golfer needed to perform this cleaning in the middle of a golf match. Also, without a proper receptacle or storage device in which to place the powder that was removed, this powder would be discarded since it would be too difficult to hold it, keep it dry, and refill the cylinder with it. If the golfer did not bring extra powder and a funnel to replace the removed and discarded powder, then the device would be rendered useless for the rest of that round of golf.

f. Much like traditional coin-sized ball markers, this device also offers limited promotional value to corporations and golf courses that want to prominently display their names and logos. It is small and easily lost or misplaced, thus limiting the duration of the promotional benefit. It is also mostly kept in the golfer's pocket or in a golf bag pocket, thus dramatically limiting the visibility of the corporation's or golf course's name and logo.

BRIEF DESCRIPTION OF THE DRAWINGS

The invention may best be understood by referring to the following description and accompanying drawings that are used to illustrate embodiments of the invention.

Certain embodiments of the invention relate to a powder dispensing ball marker and divot repair tool (referred to as "mark/repair tool"). Certain details are set forth below in order to provide a thorough understanding of various embodiments of the invention, albeit the invention may be practiced through many embodiments other that those illustrated. Well-known components and fastening techniques are not set forth in detail in order to avoid unnecessarily obscuring this description.

I. First Embodiment

Figure 1:
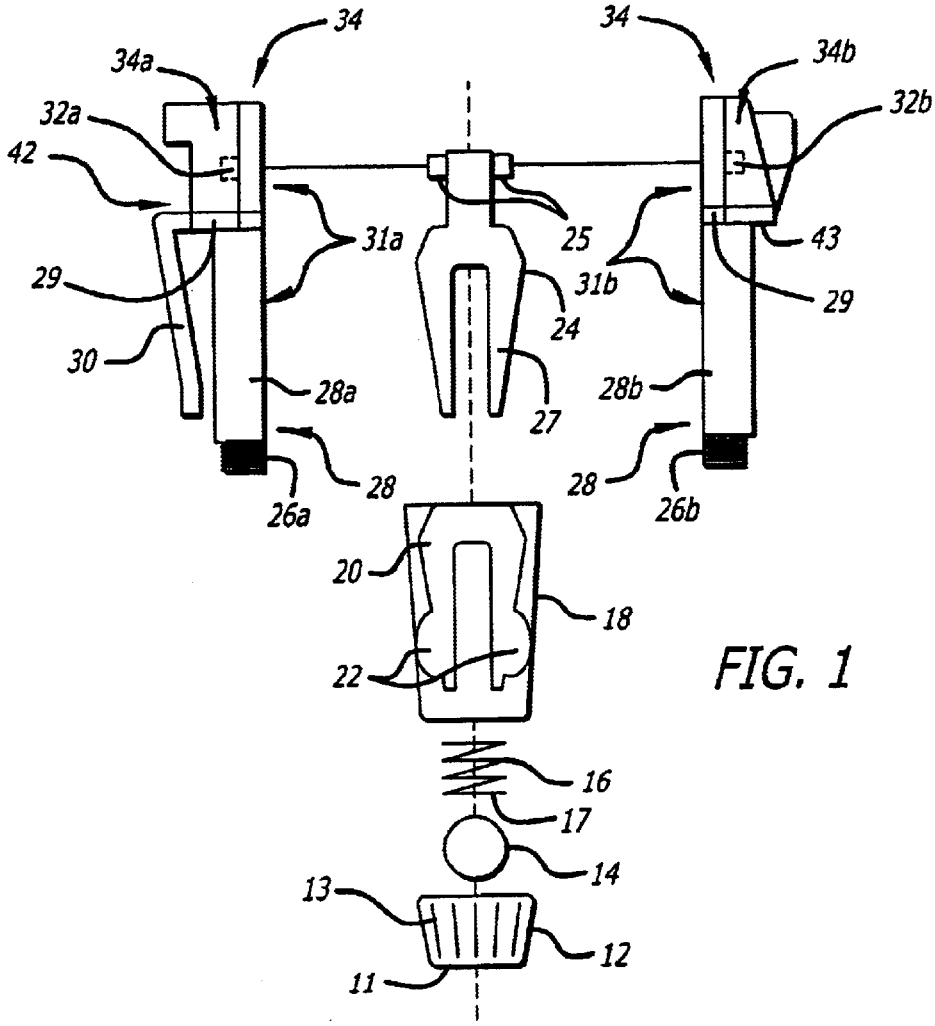
FIG. 1 is an exploded view of a first embodiment of the invention with all the components that are to be assembled into the ball marking and divot repair tool.

Referring to FIG. 1, an exemplary embodiment of an exploded view of a first embodiment of a powder ball marking and divot repair tool is illustrated. As shown, a plurality of components are assembled to produce a powder dispensing ball marker and divot repair tool (referred to as "mark/repair tool") 1.

Two of these components include the two separate halves forming combined units 31*a* and 31*b*.A first combined unit 31*a* comprises a powder chamber 28*a* and a first divot axle housing 34*a* attached together through a fastening mechanism (e.g., mechanical fastener, adhesive, etc.) or manufactured as a single element. A second combined unit 31*b* comprises a powder chamber 28*b* and a second divot axle housing 34*b* complementary to and configured for coupling with the first combined unit 31*a*.

As shown, powder chambers 28*a* and 28*b* are complementary halves, which collectively form a storage container for powder. As one embodiment, the placement of powder chambers 28*a* and 28*b* in physical contact with each other produces a generally cylindrical powder chamber 28 that is hollow. The powder chamber 28 features an enclosed top end 29 and a threaded opening collectively formed by bottom ends 26*a* and 26*b*.

Each divot axle housing 34*a* and 34*b* comprises several sub-components as will be shown in FIG. 2, 3, 4, and 5 to collectively form divot axle housing 34. A waistband clip 30 is located at the back side of divot axle housing 34*a* extending out of a base 42 of divot axle housing 34*a*.

During the assembly process, each combined unit 31*a* and 31*b* is brought together with an axle 25 of a divot repair tool 24 being captured by complementary female slots 32*a* and 32*b* placed within combined units 31*a* and 31*b*.Once combined units 31*a* and 32*b* are locked together with ends of axle 25 of divot repair tool 24 positioned at least partially within female slots 32*a* and 32*b*, a sleeve 18 is slid on over the powder chamber and locked in place up against bases 42, 43 of divot axle housings 34*a* and 34*b*, respectively.

Divot repair tool 24 then is snapped closed into a cut-out portion 20 of sleeve 18. To place divot repair tool 24 into an opened position, the thumb and forefinger of the user is inserted into tapered indentations 22 in sleeve 18 in order to grip a backside of a fork portion 27 of divot repair tool 24. The user then pulls divot repair tool 24, which rotates along axle 25.

The diameter of the bottom opening of sleeve 18 is generally equivalent to an outside diameter of the powder chamber bottom formed bottom ends 26*a* and 26*b*, thus allowing sleeve 18 to fit snuggly in place. Complementary locking mechanisms placed on the inside of sleeve 18 (not shown) and the outside of the resultant powder chamber 28 also keep sleeve 18 from twisting or moving once it is slipped on.

As shown in FIGS. 2, 3, 4, and 5, an outside surface of sleeve 18 may feature a hardened plastic material, perhaps with the random dimple pattern similar to a real golf ball as shown. Of course, alternative materials may be used. For instance, the outside surface of sleeve 18 may feature golf glove leather composition or another material such as graphite, metal (e.g., including precious metal) or the like. These alternative sleeve compositions will be attached to combined units 31*a* and 31*b* to produce the assembled mark/repair tool 1.

As further shown in FIG. 1, a spring 16 is inserted about halfway into powder chamber 28 through an opening formed by bottom ends 26*a* and 26*b*. Spring 16 comes into contact with an internal retaining ring (e.g., two or more posts or other types of protrusions formed within an inner wall of powder chamber 28) to prevent spring 16 from going further into powder chamber 28. A ball 14 is then placed in physical contact with an end 17 of spring 16 and a collar 12. Then, collar 12 is rotated onto threaded bottom ends 26*a* and 26*b* of the resultant powder chamber 28. Collar 12 has an opening 11 and raised grips 13 on an outside surface to aid in gripping while rotating for fastening on and removing from threaded bottom ends 26*a* and 26*b*. Of course, before spring 16 is inserted, powder chamber 28 needs to be filled with a powder such as powdered chalk or talcum. A variety of powder colors can be supported.

Figure 2:
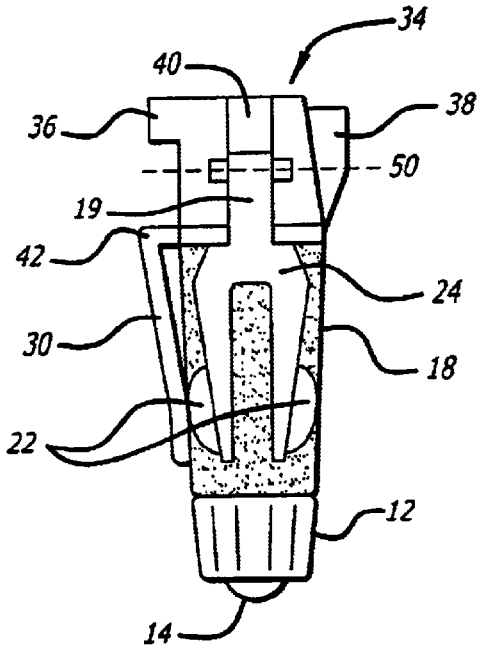
FIG. 2 is an exemplary embodiment of the left side of the mark/repair tool of FIG. 1 after assembly with divot repair tool fork in a closed position.

More specifically, with respect to FIG. 2, an exemplary embodiment of the left side of the mark/repair tool 1 of FIG. 1 after assembly of sleeve 18 with divot repair tool 24 in a closed position is shown. When divot repair tool 24 is opened, axle 25 rotates on an axis 50 until a shaft 19 of divot repair tool 24 comes into contact with an upper half of slot 40, which is part of the axle divot housing 34. Shaft 19 of divot repair tool 24 generally rests within a lower half of slot 40 when divot repair tool 24 is in the closed position.

Also shown in FIG. 2 is a left side view of a belt loop bridge 36. Note how it extends backward beyond the width of sleeve 18 and base 42 of divot axle housing 34*a* of FIG. 1. This is to allow mark/repair tool 1 to lie comfortably flush against the body of the golfer when it clipped to the belt loop.

When collar 12 is fully screwed on, ball 14 is pushed solidly up against the inner tapered end of collar 12 by spring 16, leaving slightly less than half of ball 14 protruding from bottom opening 11 of collar 12. The powder will not leak out because ball 14 is firmly pressed closed against the tapered end of collar 12. When upward pressure is applied to ball 14, a small gap inside collar 12 between ball 14 and opening 11 is created. This allows a small amount of powder to fall down around the inner half of ball.

To use this invention to place a powder mark on the green, ball 14 is simply pressed against the turf. This causes upward pressure on ball 14. As a result, ball 14 is pushed against the tension of spring 16 into collar 12 and simultaneously into the opening of powder chamber 28 until it stops, generally plugging the opening to powder chamber 28. While ball 14 is making this movement, the previous amount of powder that had filled the inner part of collar 12 around the inner half of ball 14 will flow out of collar opening 11 thus leaving a round powder mark on the putting surface. Additional, unnecessary powder is prevented from flowing out of mark/repair tool 1 because ball 14 is generally plugging the powder chamber opening.

Figure 4:
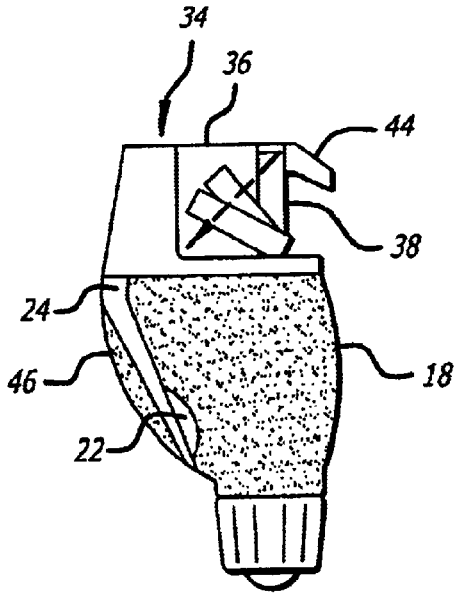
FIG. 4 an exemplary embodiment of the front side of the mark/repair tool of FIG. 1 after assembly with the divot repair tool fork in a closed position.
Figure 5:
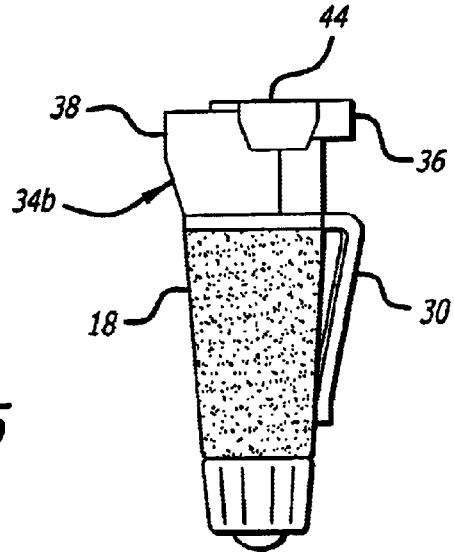
FIG. 5 an exemplary embodiment of the right side of the mark/repair tool of FIG. 1 after assembly.

The left side view of the belt loop clip swinging spring loaded on-off door 38 more clearly depicted in FIGS. 4 and 5 is also shown. Also note that the female slots 32*a* and 32*b* for axle 25 of divot repair tool 24 are shown in FIG. 2. However, these slots 32*a* and 32*b* are actually inside the divot axle housings 34*a* and 34*b* and cannot be seen from the outside.

Figure 3:
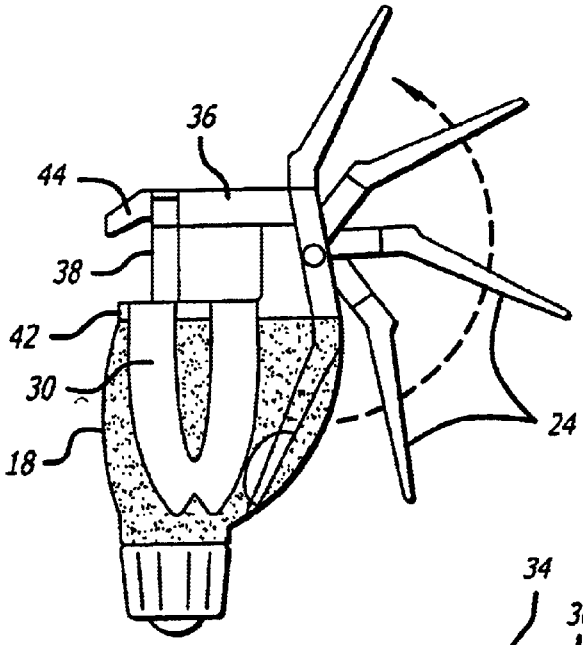
FIG. 3 is an exemplary embodiment of the rear side of the mark/repair tool of FIG. 1 after assembly with the divot repair tool fork in an opened position.

Referring to FIG. 3, an exemplary embodiment of the rear side of mark/repair tool 1 of FIG. 1 after assembly with the divot repair tool fork in an opened position is illustrated. Belt loop bridge 36 can be more clearly seen. When the invention is clipped to the golfer's belt loop, bridge 36 will be behind the belt loop thus holding the device on.

To put mark/repair tool 1 on a belt loop, the golfer will hold mark/repair tool 1 perpendicular to the golfer's body and use a no-look quick catch hook 44 to grab the belt loop. Then the golfer will slide mark/repair tool 1 forward with hook 44 sliding behind the belt loop. This will cause the belt loop clip swinging spring loaded on-off door 38 to be pushed open.

Once the quick catch hook 44 is slid fully behind the belt loop and appears on the other side, the golfer can either release mark/repair tool 1 and let if fall parallel to the body, or while mark/repair tool 1 is still in his/her hand it can be swung down to a parallel position with belt loop bridge 36 holding it onto the belt loop.

Alternatively, the golfer can use the waistband clip 30 to clip mark/repair tool 1 onto his or her waistband.

Note that FIG. 3 also shows how divot repair tool 24 swings on its axle and then snaps into either the open or closed position. When placed in an opened position, divot repair tool 24 is angularly contoured to be comfortably held in the palm of the golfer's hand, thus allowing for easy leverage to be used to repair the indentation/divot in the green.

Referring now to FIG. 4, an exemplary embodiment of the front side of mark/repair tool 1 of FIG. 1 after assembly with the divot repair tool fork in a closed position is shown. It is contemplated that a portion 46 of sleeve 18 protrudes through a gap between fork prongs 24 when divot repair tool 24 is in the closed position.

Referring to FIG. 5, an exemplary embodiment of the right side of mark/repair tool 1 of FIG. 1 after assembly. The no-look quick belt loop hook 44 can be seen. In addition, belt loop clip swinging spring loaded on-off door 38 is also clearly seen from this side. Note that door 38 only extend about two thirds of the way to the back side of divot axle housing 34*b*. When mark/repair tool 1 is already attached to the golfer's belt loop, there needs to be room for door 38 to be pushed down/open and not have the belt loop get in the way. As a result, door 38 does not extend all the way to the back side. Also note that the front/left/top side of door 38 protrudes past the width of sleeve 18. This protrusion provides extra room to the front side of the no-look hook for the golfer's thumb to easily catch and push down/open door 38, thus making it also no-look and quick/easy for getting off the belt loop.

In summary, from the description of the first embodiment set forth above and shown in FIGS. 1–5, a number of advantages associated with marker/ repair tool 1 are evident:

a. If ball 14 needs cleaning or if chalk gets clogged, powder chamber 28 does not need to be emptied to gain access to ball 14 and powder outflow area. Marker/ repair tool 1 can simply be turned upside down and collar 12 rotated and/or removed. This then allows for easy cleaning and quick replacement of ball 14 and collar 12.

b. When divot repair tool 24 is not in use and therefore snapped into its sleeve cutout section 20, the tips of the fork 24 are safely out of the way thus avoiding injury or damage to clothing.

c. When divot repair tool 24 is being used and therefore is snapped into shaft slot 40, marker/repair tool 1 fits comfortably in the palm of the hand thus providing for easier leverage in repairing putting surface indentations/divots.

d. As a palm sized device that can be clipped to a belt loop, waistband, or to a golf bag, marker/repair tool 1 is not easily lost or misplaced unlike other much smaller ball marker and divot repair devices. It will also not be easily forgotten like other ball marker or divot repair devices carried in a golf bag pocket or golf cart compartment when the golfer retrieves his/her putter and walks to the green.

e. Marker/repair tool 1 is designed to lie flat against the body when clipped onto either the belt loop or waistband. Therefore, it remains comfortable to wear and will not bother the golfer, unlike other ball marker and divot repair devices that, if carried by the golfer, are placed in his or her pocket.

f. With a no-look quick belt loop hook, marker/repair tool 1 is easy and fast to put on. Also, with its no-look easy-grab swinging clip door 38, it is easy and fast to remove from the belt loop.

g. Marker/repair tool 1 has a broad front surface area that is ideal for placing a corporate name and logo. And since it is worn on the belt loop or waistband or clipped to the outside top of the golf bag, it provides outstanding visibility for the corporate name and logo. The promotional benefits are therefore far greater than a small device that is placed in either the golfer's pocket, a golf bag pocket, or in a golf cart compartment.

II. Second Embodiment

Figure 6:
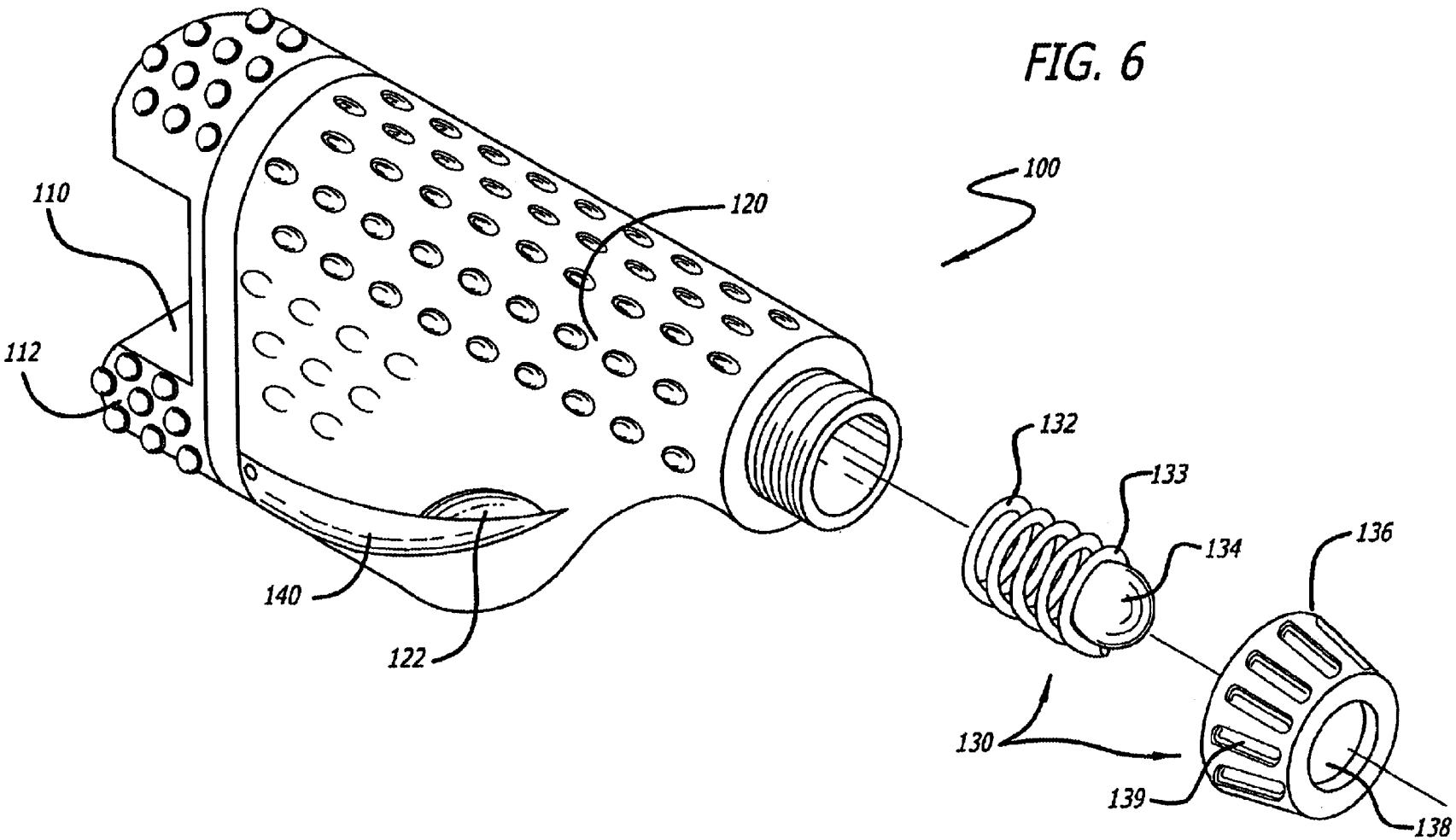
FIG. 6 is a second exemplary embodiment of the mark/repair tool.

Referring to FIG. 6, an exemplary embodiment of a perspective view of a second embodiment of a powder ball marking and divot repair tool ( "mark/repair tool") 100 is illustrated. Mark/repair tool 100 comprises a divot axle housing 110, a sleeve 120, a powder release mechanism 130, a divot repair tool 140 and a waistband clip 150 (not shown, see FIG. 7). Covered by sleeve 120, a powder chamber 160 contains powder for ball marking usage. As shown, concave indentations 122 are positioned on sleeve 120 to be partially under divot repair tool 140 having a substantial angular contour. Convex bumps 112 are positioned on a divot axle housing 110 to provide additional friction for assistance in removal of mark/repair tool 100 from a belt when attached by waistband clip 150.

Figure 7:
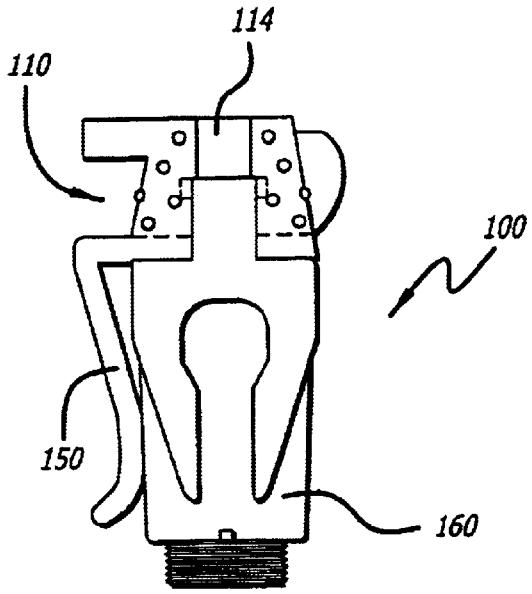
FIG. 7 is an exemplary embodiment of a left side of the mark/repair tool of FIG. 6 before final assembly and placement of the sleeve with a divot repair tool fork in a closed position.

Referring now to FIG. 7, an exemplary embodiment of a left side of mark/repair tool 100 of FIG. 6 before final assembly and placement of sleeve 120 is shown. Separate and complementary halves are combined to form divot axle housing 110 and powder chamber 160, leaving a slot 114 to allow divot repair tool 140 to be rotated. Also, waistband clip 150 is coupled to divot axle housing 110 and is configured with an exaggerated curvature to allow easier placement on a waistband of pants, a belt or other article or accessory of clothing.

Figure 8:
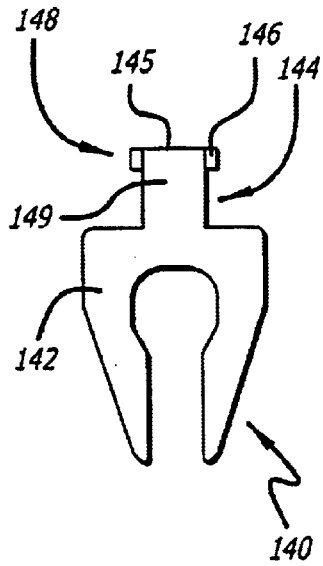
FIG. 8 is an exemplary embodiment of a side view of the divot repair tool fork of the mark/repair tool of FIG. 6.

As shown in both FIGS. 7 and 8, divot repair tool 140 comprises a repair fork 142 and a connection shaft 144 having at least one post 146 positioned at a top end 145 of connection segment 144. Two oppositely directed posts 146 are used for this embodiment. The post(s) 146 are inserted into corresponding female spacing(s) of divot axle housing 110 as that post(s) 146 produce an axle 148. This allows divot repair tool 140 to be rotated from a closed position of FIG. 7 about the axle until a top surface 149 of shaft 144 comes into contact with slot 114.

Figure 9:
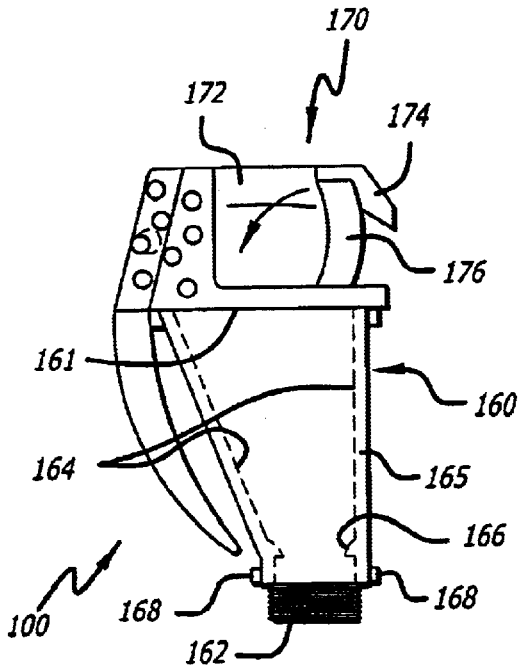
FIG. 9 is an exemplary embodiment of a front side of the mark/repair tool of FIG. 6 before final assembly and placement of the sleeve with a divot repair tool fork in a slightly opened position.
Figure 10:
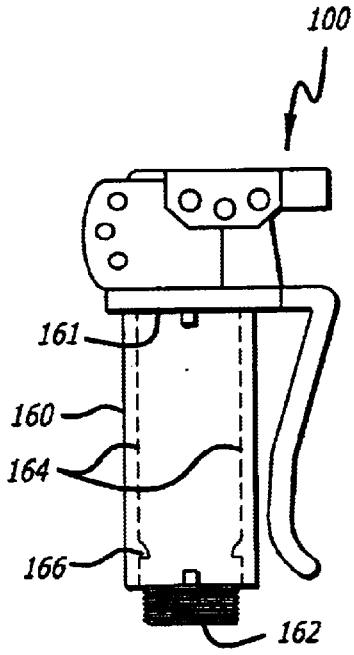
FIG. 10 is an exemplary embodiment of a right side of the mark/repair tool of FIG. 6 before final assembly and placement of the sleeve and collar.

Referring now to FIGS. 7, 9 and 10, powder chamber 160 is a partially cylindrical structure that is hollow to contain powder. Powder chamber 160 features an enclosed top end 161 and an opening at bottom end 162 (optionally threaded as shown), which is directly coupled to powder release mechanism 130 of FIG. 6. Along an inner wall 164 of powder chamber 160, internal structure 166 (e.g., two or more posts or other types of protrusions formed along inner wall 164) is used by powder release mechanism 130.

In particular, as shown in FIG. 6, powder release mechanism 130 comprises a spring 132, a ball 134 placed in physical contact with a first end 133 of spring 132 and a collar 136. Internal structure 166 prevents spring 132 from going further into powder chamber 160. Ball 134 is in contact with first end 133 of spring 132 and collar 136 being removably coupled to bottom end 162 of powder chamber 160. Collar 136 has an opening 138 and raised grips 139 on an outside surface to aid in gripping while rotating for fastening on and removing from bottom end 162. Of course, before spring 132 is inserted, powder chamber 160 needs to be filled with either powdered substance (chalk, talcum, etc.).

As further shown in FIG. 9, an exterior structure 168 (e.g., two or more posts formed along outer wall 165) are used for maintaining sleeve 120 in place. This may be accomplished by sleeve 120 having a complementary structure that securely snaps onto exterior structure 168.

In addition, as shown in FIG. 9, an attachment mechanism 170 positioned on divot axle housing 110. Attachment mechanism 170 comprises a belt loop bridge 172, a catch hook 174, and a spring-loaded attachment door 176. When mark/repair tool 100 is clipped to the golfer's belt loop, bridge 172 will be behind the belt loop thus holding the tool on. To place mark/repair tool 100 on a belt loop, a golfer will hold mark/repair tool 100 perpendicular to the body use catch hook 174 to grab the belt loop. Then, the golfer will slide mark/repair tool 100 forward with catch hook 174 sliding behind the belt loop. This will cause the spring-loaded attachment door 176 to be pushed open.

Once catch hook 174 is slid fully behind the belt loop and appears on the other side, the golfer can either release mark/repair tool 100 and let if fall parallel to the body, or while mark/repair tool 100 is still in his/her hand it can be swung down to a parallel position with belt loop bridge 172 holding it onto the belt loop.

Figure 11:
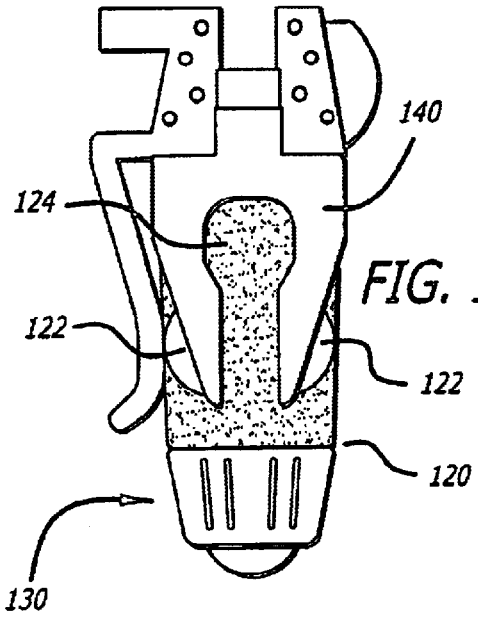
FIG. 11 is an exemplary embodiment of a left side of the mark/repair tool of FIG. 6 after assembly with a divot repair tool fork in a closed position.
Figure 12:
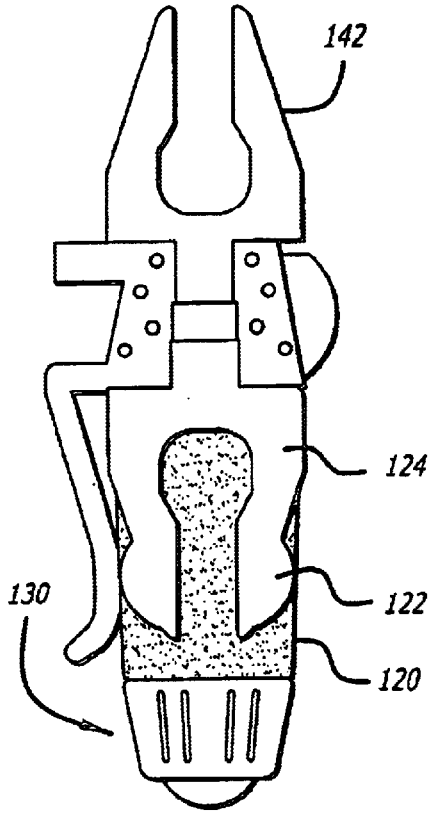
FIG. 12 is an exemplary embodiment of the left side of the mark/repair tool of FIG. 6 after assembly with a divot repair tool fork in an opened position.

Referring now to FIGS. 11 and 12, exemplary embodiments of a left side of the mark/repair tool 100 of FIG. 6 after assembly with divot repair tool 140 in both closed and open positions are shown. Sleeve 120 is attached to substantially enclose the powder chamber, which is coupled to powder release mechanism 130. A first indentation 124 having a shape substantially consistent with repair fork 142 of divot repair tool 140 is placed in sleeve 120. In addition, concave indentations 122 are generally placed on opposite sides of prong portions of first indentation 124. Since concave indentations 122 begin at a boundary area of first indentation, concave indentations 122 have a depth at least equal to and in most cases greater than the depth of first indentation 124.

III. Third Embodiment

Figure 13:
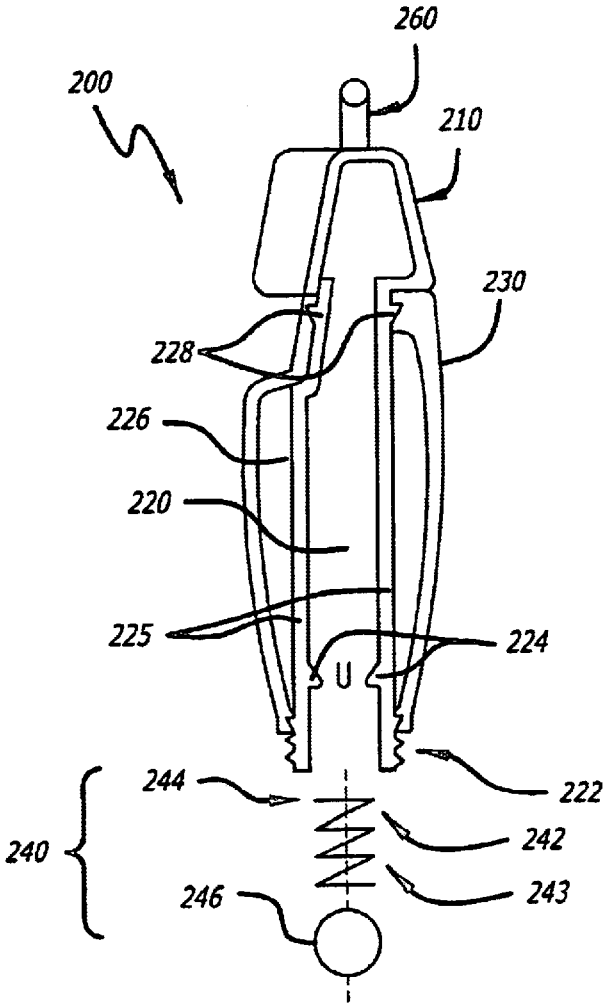
FIG. 13 is a third exemplary embodiment of the mark/repair tool.

Referring to FIG. 13, an exemplary embodiment of a cross-sectional view of a third embodiment of a mark/repair tool 200 after assembly is shown. Mark/repair tool 200 comprises an divot axle housing 210, a powder chamber 220, a sleeve 230, a powder release mechanism 240, a divot repair tool 250 (see FIGS. 14–17) and an attachment loop 260. Unlike mark/repair tools 1, 100 of FIGS. 1 and 6, powder chamber 220 extends into divot axle housing 210, which is hollow and adapted to store a powder. Mounted on a surface of divot axle housing 210, attachment loop 260 allows for mark/repair tool 200 to be attached to a fastener (e.g., chain, carabiner ring, etc.) to provide portability with the golfer.

Powder release mechanism 240 comprises a removable spring 242 and ball 246 that applies pressure to one end 243 of spring 242 being a collar (not shown) is coupled to a bottom end 222 of powder chamber 220. The another end 244 of spring 242 comes into contact with an internal structure 224 placed on an inner wall 225 of powder chamber 220. Sleeve 230 remains attached to powder chamber 220 by a snap structure 228 placed on an outer wall 226 of powder chamber 220.

Figure 14:
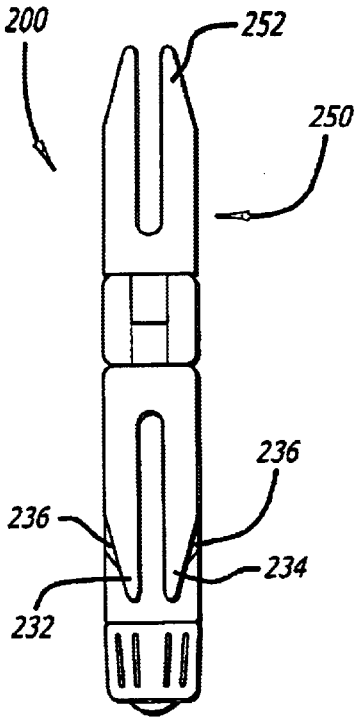
FIG. 14 is an exemplary embodiment of a back side of the mark/repair tool of FIG. 13 after assembly with a divot repair tool fork in an opened position.
Figure 15:
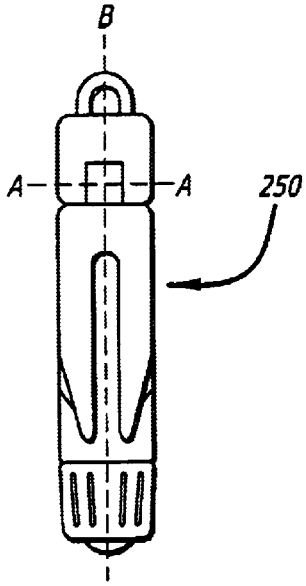
FIG. 15 is an exemplary embodiment of the back side of the mark/repair tool of FIG. 13 after assembly with a divot repair tool fork in a closed position.
Figure 16:
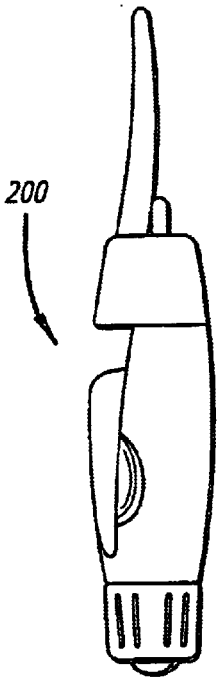
FIG. 16 is an exemplary embodiment of a left side of the mark/repair tool of FIG. 13 after assembly with a divot repair tool fork in an opened position.
Figure 17:
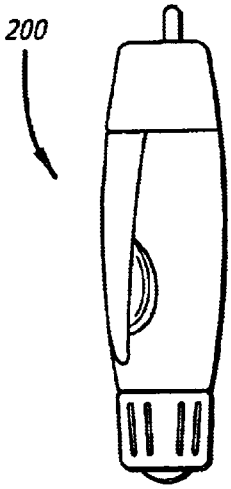
FIG. 17 is an exemplary embodiment of the left side of the mark/repair tool of FIG. 13 after assembly with the divot repair tool fork in a closed position.

Referring now to FIGS. 14 and 15, exemplary embodiments of a back side of mark/repair tool 200 of FIG. 13 after assembly with a divot repair tool fork in both opened and closed positions are shown. Similar to the other embodiments, divot repair tool 250 has a slight concave curvature when placed in an opened position. Indentations 232 and 234 within sleeve 230 are used so that a repair fork 252 of divot repair tool 250 in the closed position generally rests flush against sleeve 230 as shown in FIG. 15. Indentations 236 enable fingers of a golfer to slide under repair fork 252 before rotation and placement in an opened position. Exemplary embodiments of a left side of mark/repair tool 200 of FIG. 13 after assembly are illustrated in FIGS. 16 and 17.

IV. Fourth Embodiment

Figure 18:
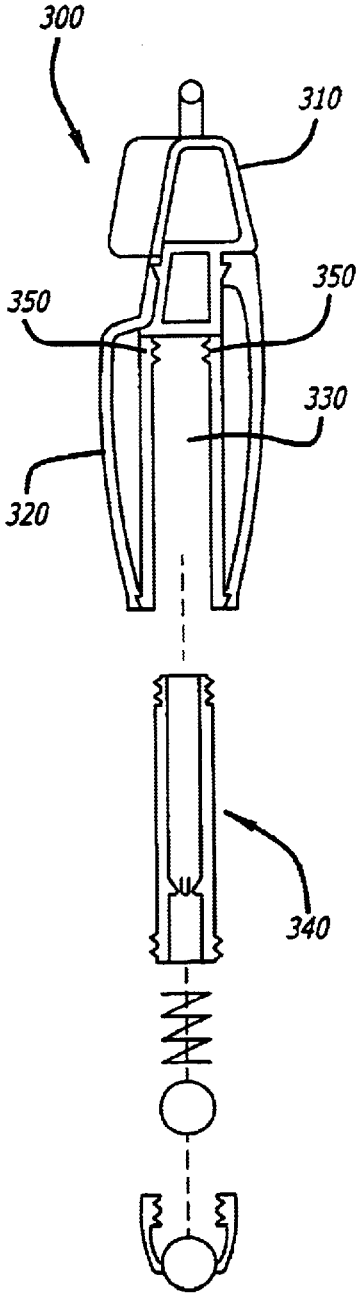
FIG. 18 is an exemplary embodiment of a fourth embodiment of the invention with a removable powder cartridge.

Referring now to FIG. 18, an exemplary embodiment of a fourth embodiment of the invention with a removable powder cartridge is shown. The removable powder cartridge 340 may be adapted for any design of mark/repair tool. For example, mark/repair tool 300 comprises divot axle housing 310, sleeve 320 and a divot repair tool (not shown) generally equivalent to those components of any of the other mark/repair tools of FIGS. 1, 6 and 13. Covered by sleeve 120, a powder chamber 330 contains powder for ball marking usage. However, instead of receiving loose, powder chamber 330 receives a powder cartridge 340. Powder cartridge 340 is inserted into powder chamber 330, which is designed with a securing mechanism 350 to maintain cartridge 340 in powder chamber 340 during use. Examples of securing mechanisms may include, but are not limited or restricted to the following: (1) a threaded portion at the top of the powder chamber 330 designed to receive a complementary threaded portion on cartridge 350; (2) spring-loaded posts that are aligned for insertion into corresponding slots in which the posts are retracted to allow cartridge 340 to be removed from powder chamber 330 (ports can be placed to extend from inner wall of powder chamber 340 or from an outer surface of cartridge 350); or (3) combination of collar and an internal structure placed on an inner wall of powder chamber 330 to prevent further movement into powder chamber 330.

While the invention has been described in terms of several embodiments, the invention should not limited to only those embodiments described, but can be practiced with modification and alteration within the spirit and scope of the appended claims. For instance, although not shown, the fastening mechanism of the mark/repair tool may be implemented differently than a waistband clip (30) or belt loop clip fastening scheme (36, 172) as set forth above. As an example, the mark/repair tool may be adapted for attachment and removal from conventional cell phone waistband clips. According to one embodiment, this may be accomplished by placing a protrusion along a side of the sleeve for mating with an opening of the waistband clip. The description is thus to be regarded as illustrative instead of limiting.

What is claimed is:

1. An apparatus comprising:

a chamber to retain a powder;

a divot repair tool;

a sleeve for substantially covering the chamber, the sleeve comprises a cut-out portion substantially consistent with a form of the divot repair tool; and an axle housing coupled to the chamber and configured to enable rotation of the divot repair tool from a first position to a second position.

2. The apparatus of claim 1 further comprising:

a collar adapted for coupling to a first end of the chamber, the collar including an opening; and a ball positioned to partially protrude from an opening of the collar to seal the opening and prevent release of the powder stored in the chamber until pressure in applied against a portion of the ball partially protruding from the opening.

3. The apparatus of claim 2 further comprising a spring applying a force against the ball to cause the ball to partially protrude from the opening.

4. The apparatus of claim 1 further comprising means for fastening to an article of clothing worn by a user or a golf bag.

5. The apparatus of claim 1 further comprising a sleeve placed over the chamber and coupled to the axle housing.

6. The apparatus of claim 5 further comprising a waistband clip coupled to the axle housing and extending over a portion of a side of the sleeve.

7. The apparatus of claim 5 further comprising a belt loop clip mechanism including a spring loaded member and a bridge member coupled to the spring loaded member and the axle housing, the spring loaded member, when closed, forms an enclosed area having perimeters formed by a side of the spring loaded member, a side of the axle housing, and a side of the bridge member.

8. The apparatus of claim 3, wherein the chamber comprises at least two protrusions that prevent the spring from extending further into the chamber.

9. The apparatus of claim 1, wherein the chamber is a conduit with one end being enclosed by a surface of the axial housing.

10. The apparatus of claim 1, wherein the chamber retains powder by retaining a removable cartridge with the powder.

11. An apparatus means for retaining powder;

a divot repair tool;

a sleeve for substantially covering the means for retaining powder, the sleeve comprises a cut-out portion substantially consistent with a form of the divot repair tool; and means for coupling the divot repair tool to the means for retaining powder and for enabling rotation of the divot repair tool from a first position to a second position.

12. The apparatus of claim 11 further comprising a sleeve for substantially covering the means for retaining powder.

13. The apparatus of claim 11, wherein the divot repair tool is in the first position when positioned within the cut-out portion with a front surface of the divot repair tool being substantially flush against the sleeve.

14. An apparatus comprising:

a chamber to retain a powder, the chamber including a first end and a second end having an opening;

a divot repair tool;

an axle housing coupled to the first end of the chamber, the axle housing to enable rotation of the divot repair tool from a first position to a second position;

a sleeve placed over the chamber and coupled to the axle housing, the sleeve including a fork-shaped cut-out portion substantially equivalent in shape with the divot repair tool;

a collar adapted for coupling to the second end of the chamber, the collar including an opening; and a ball positioned to partially protrude from the opening of the collar, seal the opening of the collar and prevent release of the powder stored in the chamber until pressure is applied against a portion of the ball partially protruding from the opening of the collar.

15. The apparatus of claim 14, wherein the chamber further comprises at least two protrusions positioned along an inner wall of the chamber.

16. The apparatus of claim 15 further comprising a spring including (i) a first end positioned against the at least two protrusions to prevent the spring from extending further into the chamber, and (ii) a second end in physical contact with ball.

17. The apparatus of claim 14 further comprising means for fastening to an article of clothing worn by a user or a golf bag.

18. The apparatus of claim 14, wherein the axial housing includes a secondary chamber adjoining the chamber, the secondary chamber to retain the powder along with the chamber.

* * * * *